US005903926A

United States Patent [19]

Fleming

[11] Patent Number: 5,903,926

[45] Date of Patent: May 18, 1999

[54] FAN NOVELTY DEVICE

[76] Inventor: Ward Fleming, 180 Woodland La., HC 1 Box 180, Palenville, N.Y. 12463

[21] Appl. No.: 09/138,533

[22] Filed: Aug. 24, 1998

[51] Int. Cl.[6] ..... A42B 1/24

[52] U.S. Cl. ..... 2/209.13; 2/244; 446/27; 446/488

[58] Field of Search ..... 2/209.13, 244; 446/27, 487, 488; D2/866, 869, 891, 895; D3/2, 3

[56] References Cited

U.S. PATENT DOCUMENTS

D. 182,999 6/1958 Glass ..... D2/869

*Primary Examiner*—Diana L. Biefeld
*Attorney, Agent, or Firm*—Howard C. Miskin

[57] ABSTRACT

A hat having a strip of fabric with an accordion folding which can be made closed or open to a fan-like structure on the top of the hat to attract attention and has entertaining and marketing values.

6 Claims, 8 Drawing Sheets

FAN NOVELTY DEVICE

FIELD OF THE INVENTION

The invention relates to a novelty device having a fan-like structure that can be easily made open and closed. The fan novelty device attracts attention and has entertaining and marketing values.

BACKGROUND OF THE INVENTION

Novelty devices are known to combine a multitude of unusual products to provide entertaining values. Aside from the intended utility of novelty items, many also draw attention, which may serve as promotional items. For example, novelty hats and caps serve the purpose of protecting the wearer's head and also have entertaining values and attract attention. Examples of novelty caps include those resembling the heads of cartoon characters, beanie caps, ski hats having long tails, etc. More generally is the use of hats and caps as promotional items, often given away to customers in marketing campaigns or sporting events. These types of hats and caps incorporate certain logos and/or phrases for marketing certain goods and/or services.

SUMMARY OF THE INVENTION

The invention provides a novelty device having a fan-like structure, essentially pivotally attached to the top of a dome-shaped body. Advantageously, the fan-like structure is formed by a strip of fabric having an accordion folding. In the closed position, the accordion folding rests essentially flat on the dome-shaped body. When the dome-shaped body tilts backwards, the accordion folding expands instantly over the dome-shaped body, creating a fan-like structure extending upwardly from the body portion and running from the front of the body across the back of the body, resembling a rooster's crown. The fan-like structure maintains its open position after the body returns to a level position. The expanse of the fan-like structure attracts attention and hence promotional materials may be incorporated on the accordion folding for high-visibility marketing.

The fan novelty device of the present invention may vary in size. The dome-shaped body may be a cap that fits over a wearer's head, allowing the wearer to expand the accordion folding by the tilt of his/her head. Alternatively, the dome-shaped body may be an attachment or an eraser that fits on the end of a pencil.

BRIEF DESCRIPTION OF THE DRAWINGS

A preferred embodiment of the present invention has been chosen for purposes of illustration and description and is shown in the accompanying drawings forming a part of the specification wherein.

DETAILED DESCRIPTION OF THE PREFERRED EMBODIMENTS

Figure 1:
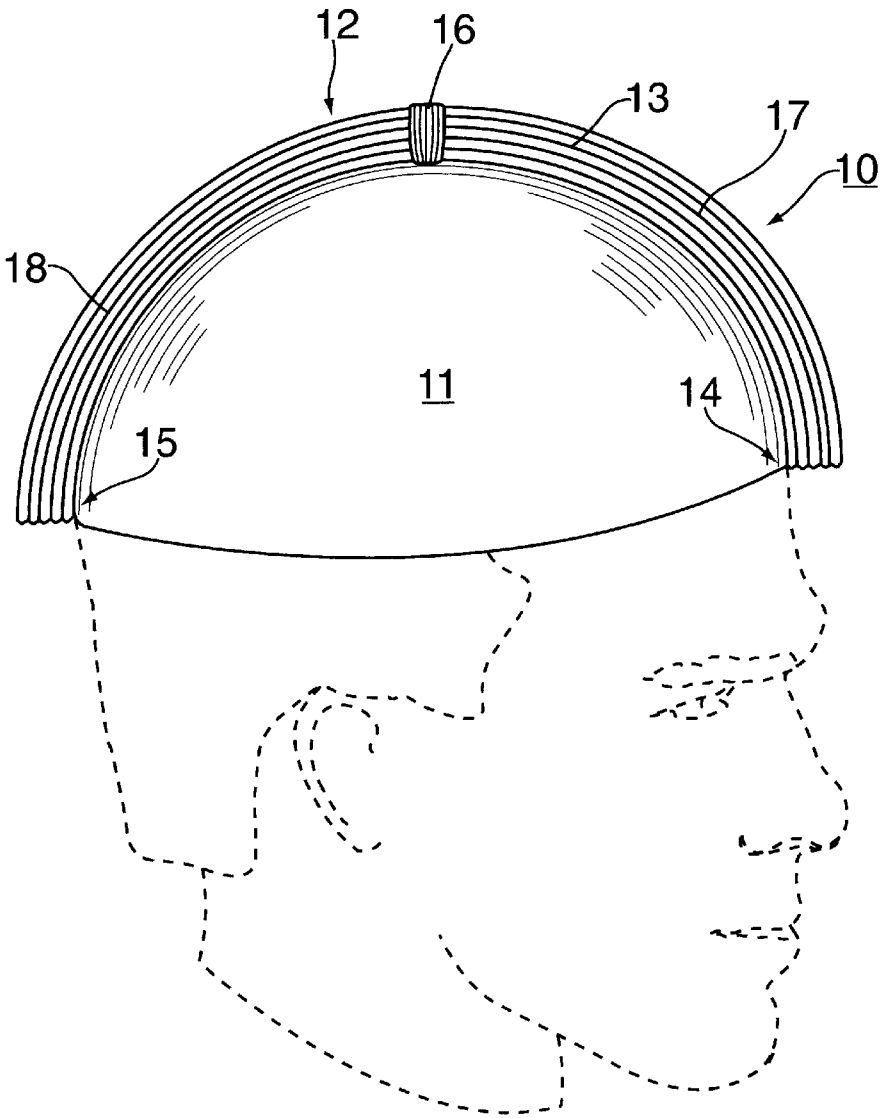
FIG. 1 is side view of the present invention with the fan-like structure in a closed position, showing the position of use.

With reference to the drawings, wherein the same reference number indicates the same element throughout, there is shown in FIG. 1 a side view of the present invention. FIG. 1 shows the fan novelty device being a fan hat 10 comprising of a dome-shaped cap 11 and a strip of fabric with an accordion folding 12 on top of cap 11.

Figure 3:
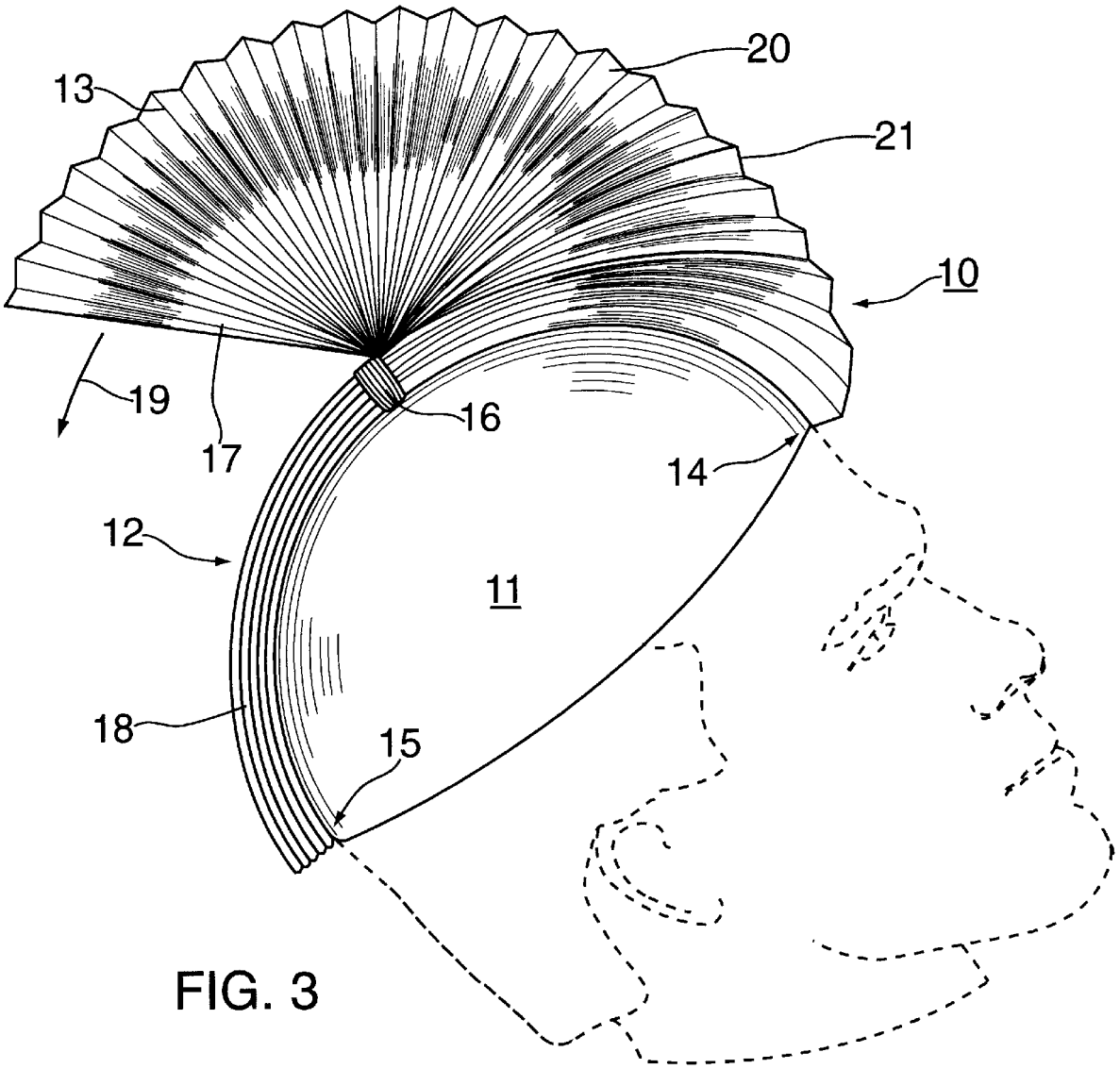
FIG. 3 is a side view illustrating the opening of the fan-like structure.
Figure 4:
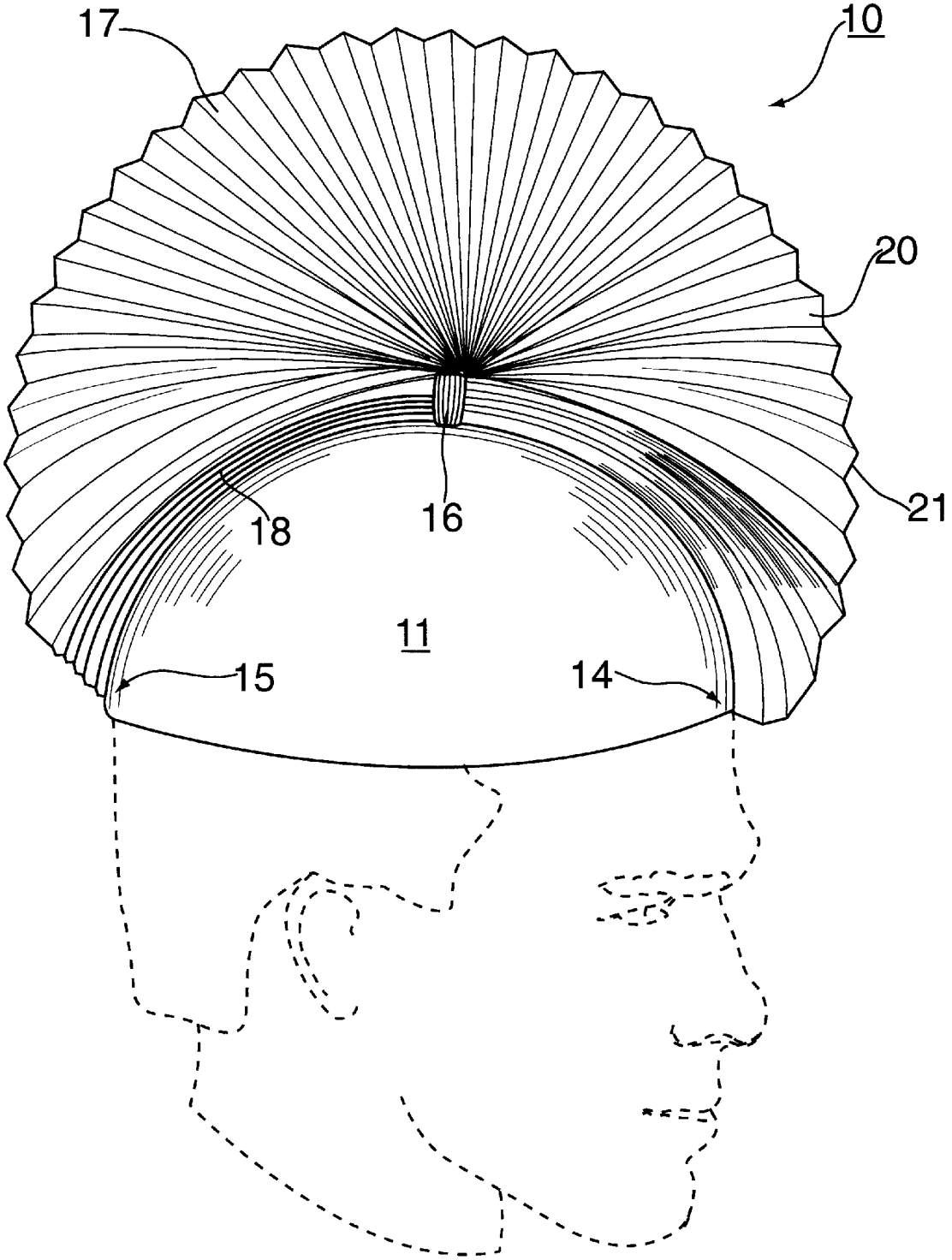
FIG. 4 is a side view of the present invention with the fan-like structure in an open position.
Figure 5:
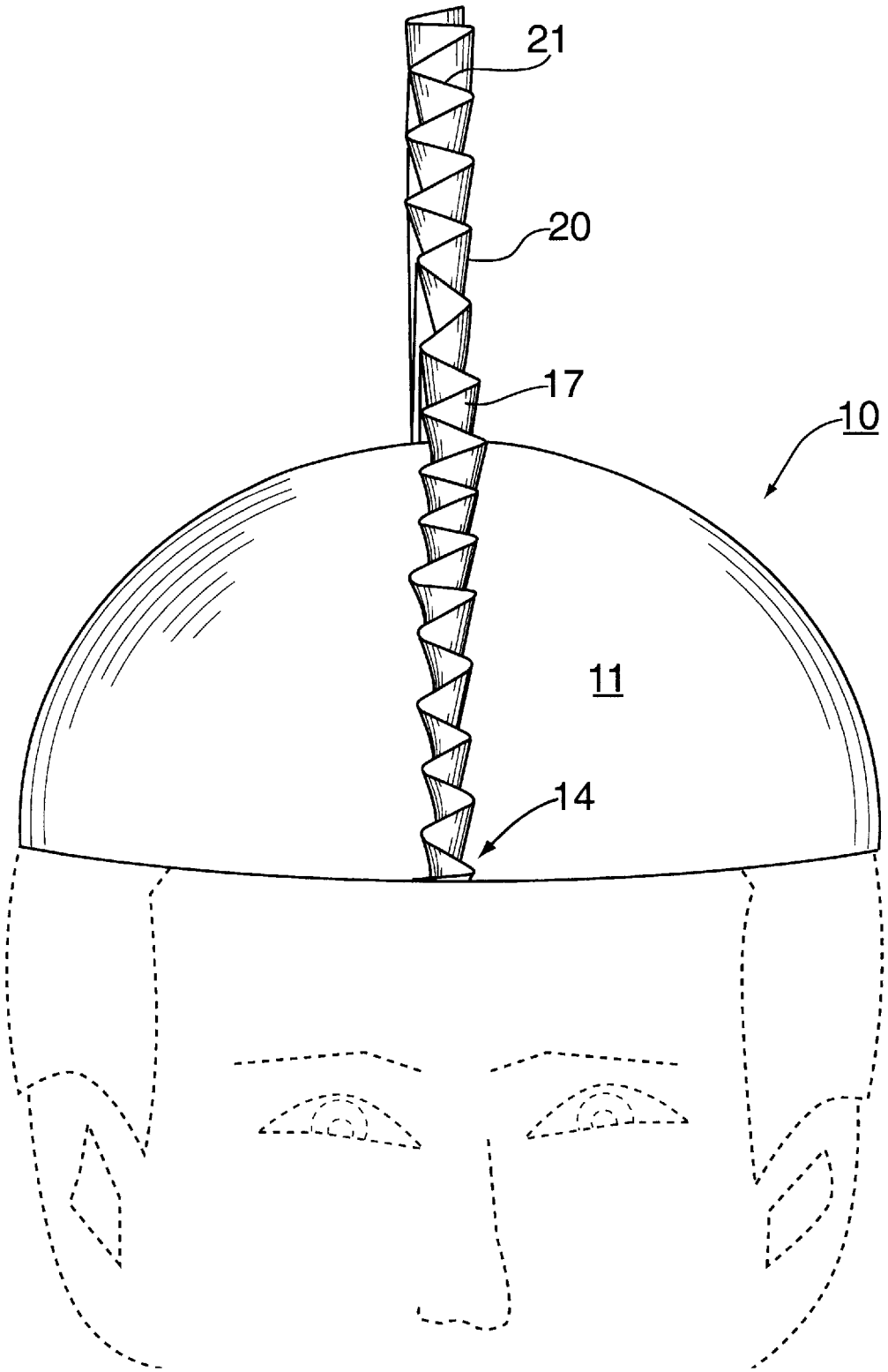
FIG. 5 is a front view of the present invention with the fan-like structure in an open position.

FIG. 1 shows fan hat 10 with a dome-shaped cap 11 that fits snugly on a wearer's head. Any type of cap made of any type of fabric may be used. For example, a knit cap, a baseball cap, rubber cap, etc. On the surface of cap 11 is a mounted strip of fabric 12 with an accordion folding 13, best shown in FIG. 2. The strip 12 is attached to cap 11 at at least three points, the front end 14, the rear end 15 and the center 16. At the front and rear ends 14 and 15, at most a few layers of the accordion folding 13 is attached to cap 11 by any means known to one skill in the art, such as, sewing, gluing, stapling, taping, Velcro® attachment etc., to allow the remaining accordion folding 13 to open to a fan-like structure 18, as shown in FIG. 3. The accordion folding 13 at the center 16 are bundled together by any means known to one skill in the art, and attached to cap 11, thereby dividing the accordion folding 13 into a front portion 17 and a rear portion 18 and creating a pivot point at center 16 for the opening of the fan-like structure 20, as shown in FIG. 3. Strip 12 is made of any stiff and pliable fabric known to one skill in the art, which allows the full opening of accordion folding 13, as shown in FIG. 4, yet maintains the upright fan-like structure 20, as shown in FIG. 5. For example, curtain fabric, upholstery material, plastic films, etc.

Figure 2:
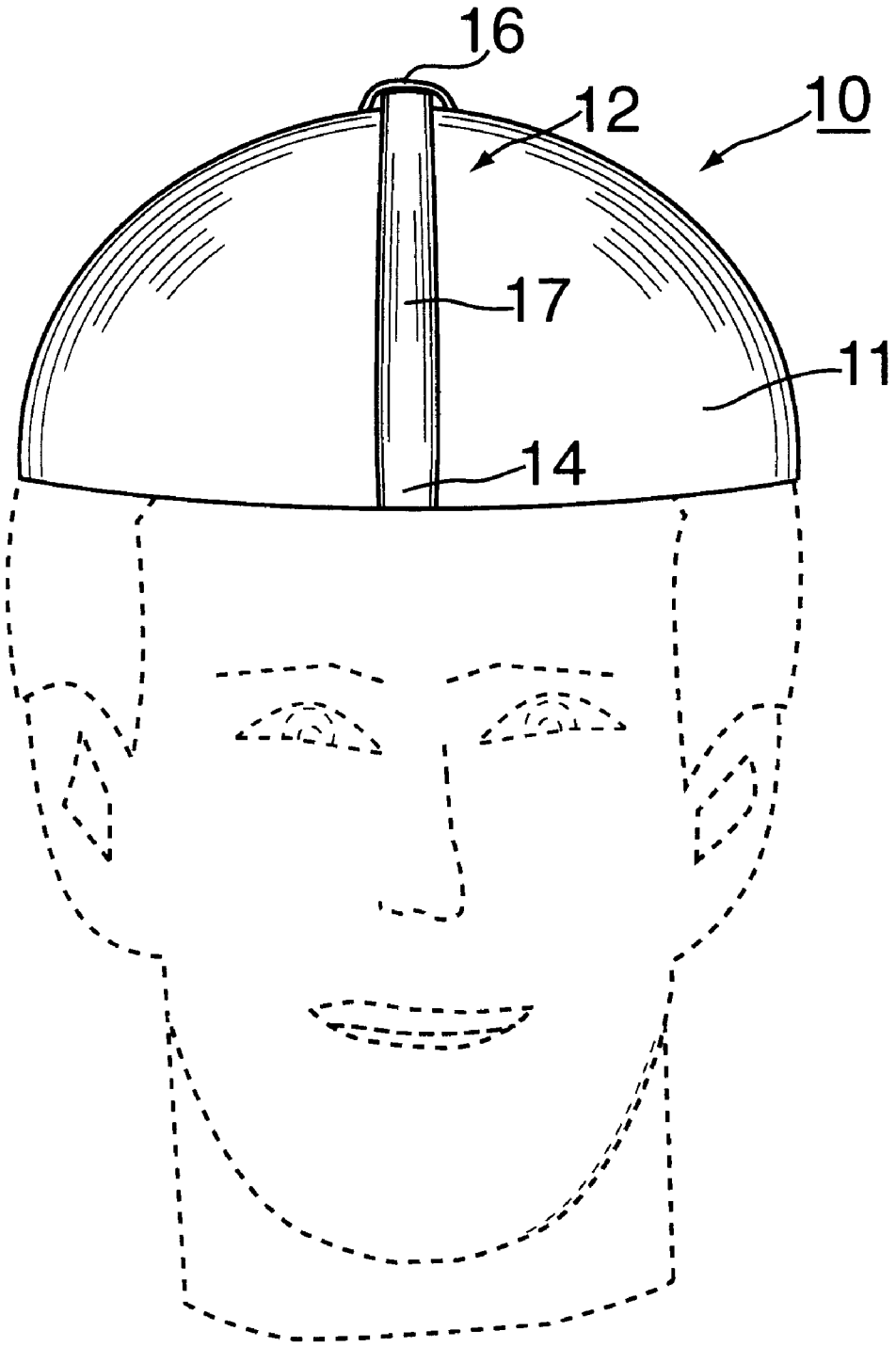
FIG. 2 is a front view of the present invention with the fan-like structure in a closed position.

FIG. 2 shows the front view of fan hat 10 with the accordion folding 13 of strip 12 in a closed position.

As illustrated in FIG. 3, the front portion 17 of accordion folding 13 may be projected backwards by tilting a wearer's head backward in the direction shown by directional arrow 19. The front portion 17 overlaps the rear portion 18 of strip 12. Upon full expansion of the front portion 17 of accordion folding 13, a fan-like structure 20 is formed, as shown in FIG. 4. The creation of fan-like structure 20 can similarly be accomplished by tilting a wearer's head forward in the direction opposite that of directional arrow 19 to allow the rear portion 18 to expand and overlaps the front portion 17 of strip 12 (not shown).

As shown in FIG. 4, accordion folding 13 of strip 12 creates a fan-like structure 20 having a substantially round edging 21. It is contemplated by the present invention that accordion folding 13 of strip 12 may have different shaped edging 21, such as scallop, spike, etc. (not shown).

After tilting the wearer's head, either forward or backward, the wearer's head may return to a leveled position while maintaining the fan-like structure 20, as shown in FIG. 4. The full opening of the accordion folding 13 allows fan hat 10 to attract attention. Hence, a great promotional item for displaying logos and/or phrases on the accordion folding 13. Furthermore, accordion folding 13 may contain different shaped cut-outs to create a different look (not shown). To return the accordion folding 13 to a closed position, as shown in FIG. 1, the wearer merely needs to tilt his/her head in the direction opposite of which opens the accordion folding 13.

Figure 6:
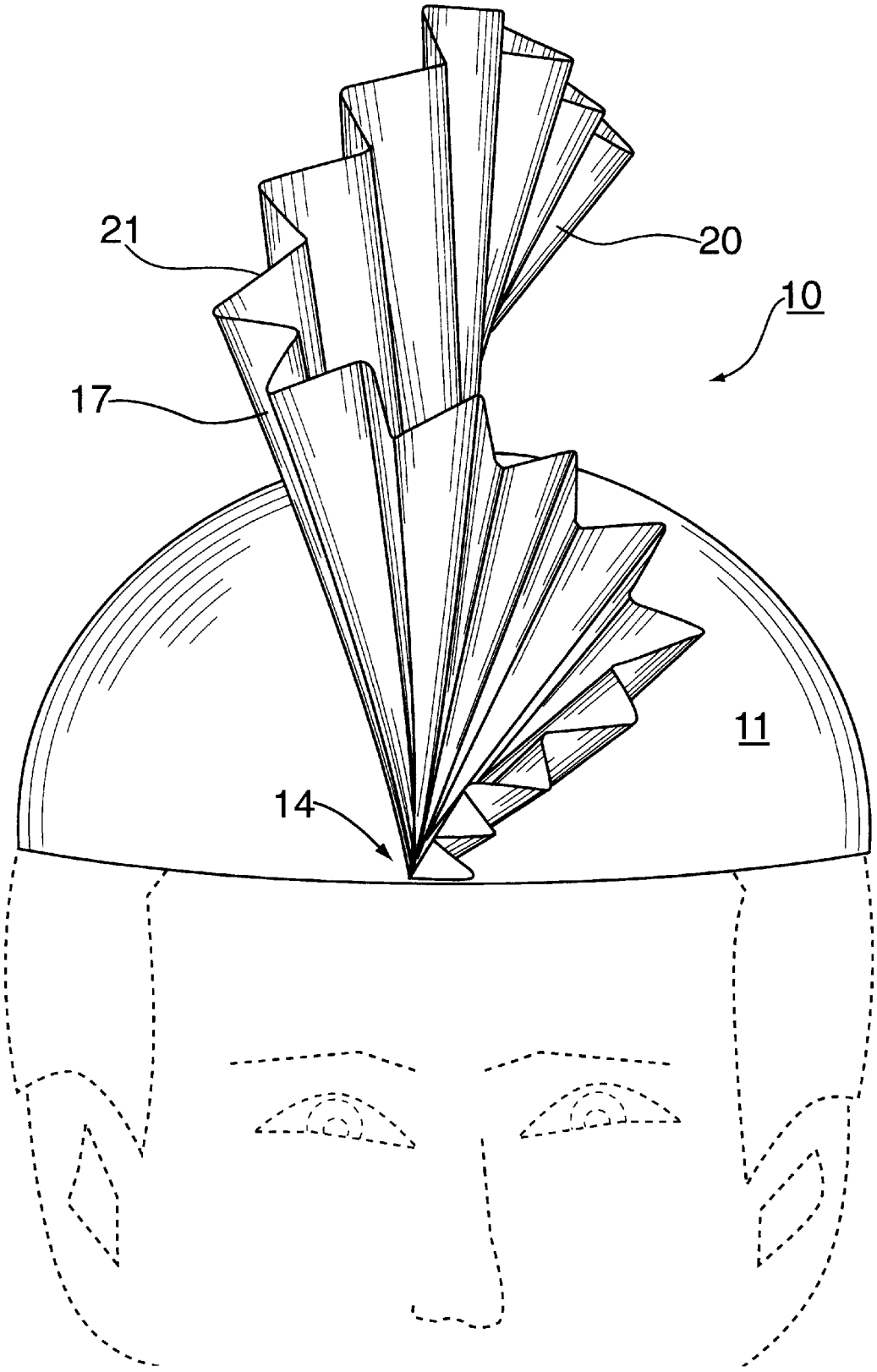
FIG. 6 is a front view of the present invention with the fan-like structure shown in a wave form.
Figure 7:
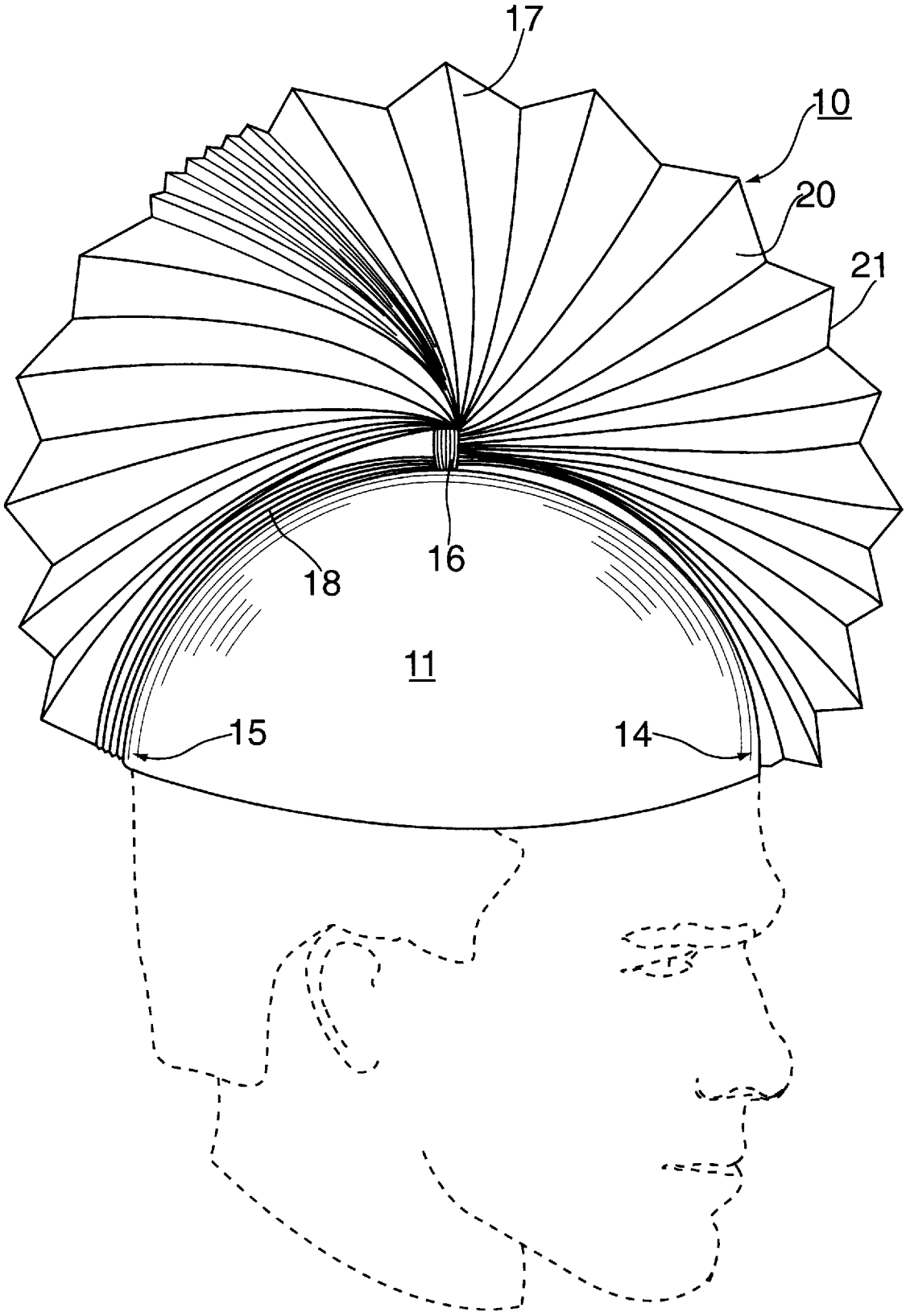
FIG. 7 is a side view of the present invention with the fan-like structure shown with a traveling wave at one position.
Figure 8:
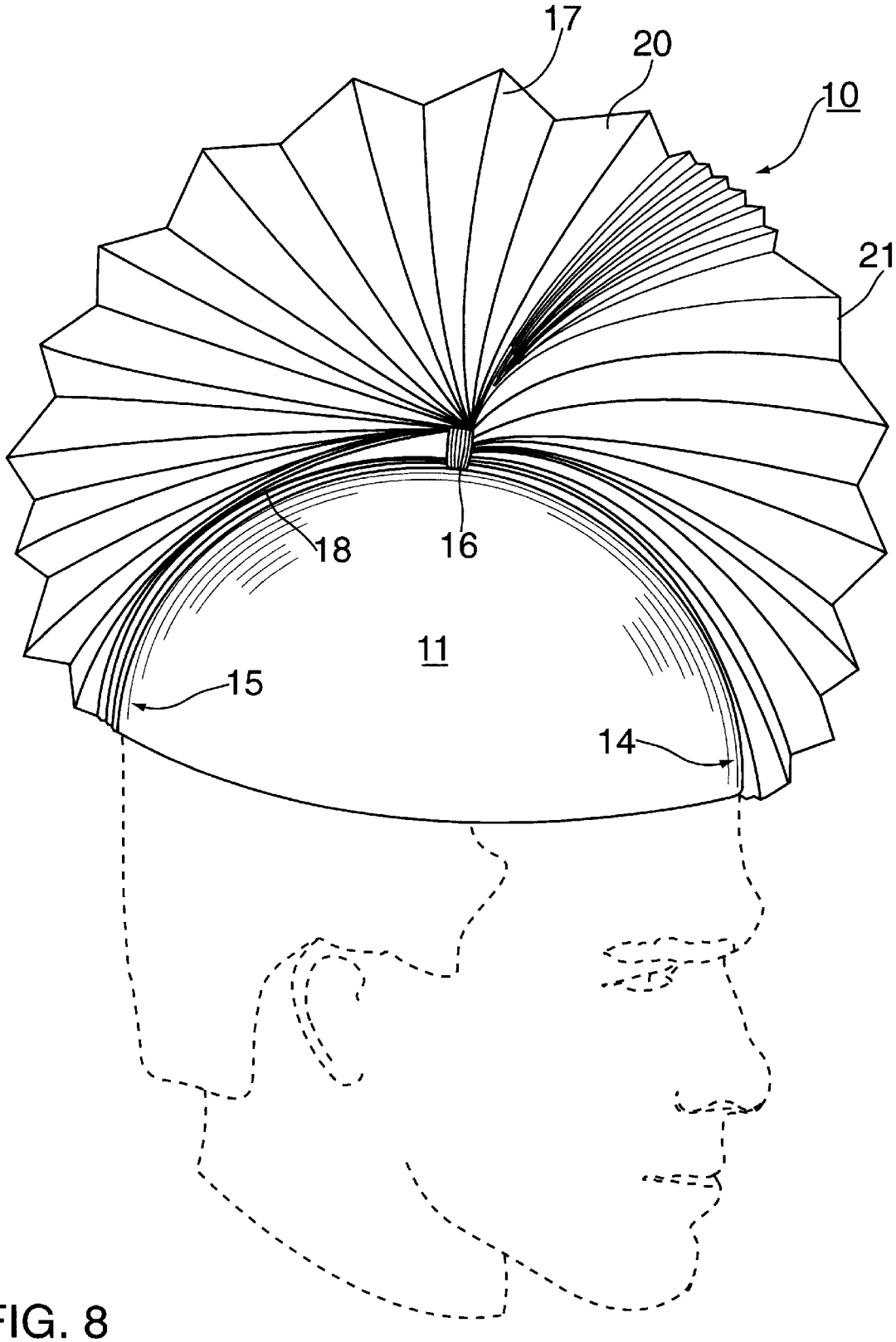
FIG. 8 is a side view of the present invention with the fan-like structure shown with a traveling wave at another position.

FIG. 5 shows the front view of fan hat 10 with the accordion folding 13 in an open, stable, position. The fan hat 10 can be further maneuvered to attract more attention. As shown in FIG. 6, with the accordion folding 13 in an open position, the wearer may turn his/her head left and right to create a wave on the fan-like structure 20. The movement of the wearer's head is transformed directly to cap 11 through strip 12 and throughout the accordion folding 13. Similarly, the wearer may gently rock his/her head back and forth to create a traveling wave from the front end 14 of strip 12 to the rear end 15 of strip 12 and vice versa. FIGS. 7 and 8 demonstrate one such traveling wave in two different positions.

In the drawing and in the preferred embodiment of the invention, the fan novelty device is shown as a fan hat 10. It will be understood that the size of the fan novelty device may decrease or increase in size, and the dome-shaped body made of different materials.

Although certain features of the invention have been illustrated and described herein, other better modifications and changes will occur to those skilled in the art. It is, therefore, to be understood that the appended claims are intended to cover all such modification and changes that fall within the spirit of the invention.

What I claim is:

1. A fan novelty device, comprising:

(a) a dome-shaped body;

(b) a strip of pliable material being accordion folded; and (c) means for attaching said strip of material to said dome-shaped body to allow the opening and closing of said accordion folding along said body.

2. The device according to claim 1, wherein said device is to be worn on the head, wherein said dome-shaped body is a cap mounted and shaped to sit on said head of the wearer.

3. The device according to claim 2, wherein said cap having a front and rear ends and a center, said strip of pliable material is attached to said cap at said front end, said rear end and said center of said cap, creating a pivot point at said center of said cap where said accordion folding is pivotable from closed to open positions to form a fan-like structure.

4. The device according to claim 2, wherein said strip of pliable material is also made of a stiff material allowing said accordion folding to open, form and maintain a fan-like structure.

5. The device according to claim 2 wherein said cap is made of a knit material.

6. The device according to claim 1, wherein said device is to be mounted on the end of a writing instrument, said dome-shaped body is an eraser.

* * * * *